US005941410A

United States Patent [19]

Mangano

[11] Patent Number: 5,941,410

[45] Date of Patent: Aug. 24, 1999

[54] MOP BUCKET HAVING A MOP STABILIZING STRUCTURE

[76] Inventor: Joy Mangano, 49 Sunhill Road, Nesconset, N.Y. 11767

[21] Appl. No.: 08/955,586

[22] Filed: Oct. 22, 1997

Related U.S. Application Data

[63] Continuation-in-part of application No. 08/746,504, Nov. 12, 1996, Pat. No. 5,813,567.

[51] Int. Cl.[6] ..... B65D 25/28

[52] U.S. Cl. ..... 220/735; 220/702; 220/697; 220/730; 15/264

[58] Field of Search ..... 220/732, 702, 220/697, 730; 15/264

[56] References Cited

U.S. PATENT DOCUMENTS

| | | | |
|---|---|---|---|
| 571,438 | 11/1896 | Harlow | 220/697 |
| 2,255,091 | 9/1941 | Vaughn | 15/264 |
| 2,461,893 | 2/1949 | Guagliano | 220/702 |
| 2,644,183 | 7/1953 | Kellett | 220/697 |
| 2,738,531 | 3/1956 | Gerosa | 15/264 |
| 3,756,451 | 9/1973 | Popeil | 15/264 |
| 4,995,526 | 2/1991 | Garrison | 15/264 |
| 5,400,916 | 3/1995 | Weber | 220/697 |

*Primary Examiner*—Joseph M. Moy
*Attorney, Agent, or Firm*—Galgano & Burke

[57] ABSTRACT

A mop stabilizing structure for use in a mop bucket includes a shelf having notched portion which serves to grasp a mop handle to maintain the mop in a vertical position in the mop bucket. Preferably, the notch portion is made from a thin web-like material which forms a narrow lip along the inner periphery thereof which acts to firmly secure the mop in an upright position. The mop bucket preferably includes button-like locking mechanisms which maintain the handle in a rigid, stationary and vertical position relative to the mop bucket which, during handling and transport of the mop bucket, prevents the mop bucket from tipping. The base of the bucket also preferably includes an anti-skid surface composed of rows of raised protrusions, one row of which is aligned with the free end of the shelf to maintain the mop in an upright position during handling.

15 Claims, 8 Drawing Sheets

FIG. 10A
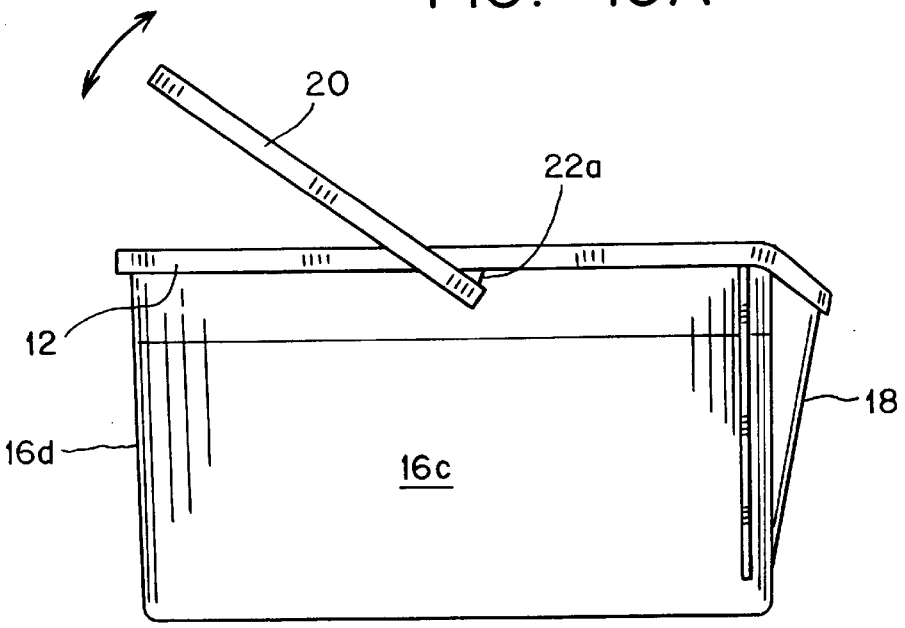
FIG. 10C
FIG. 10B
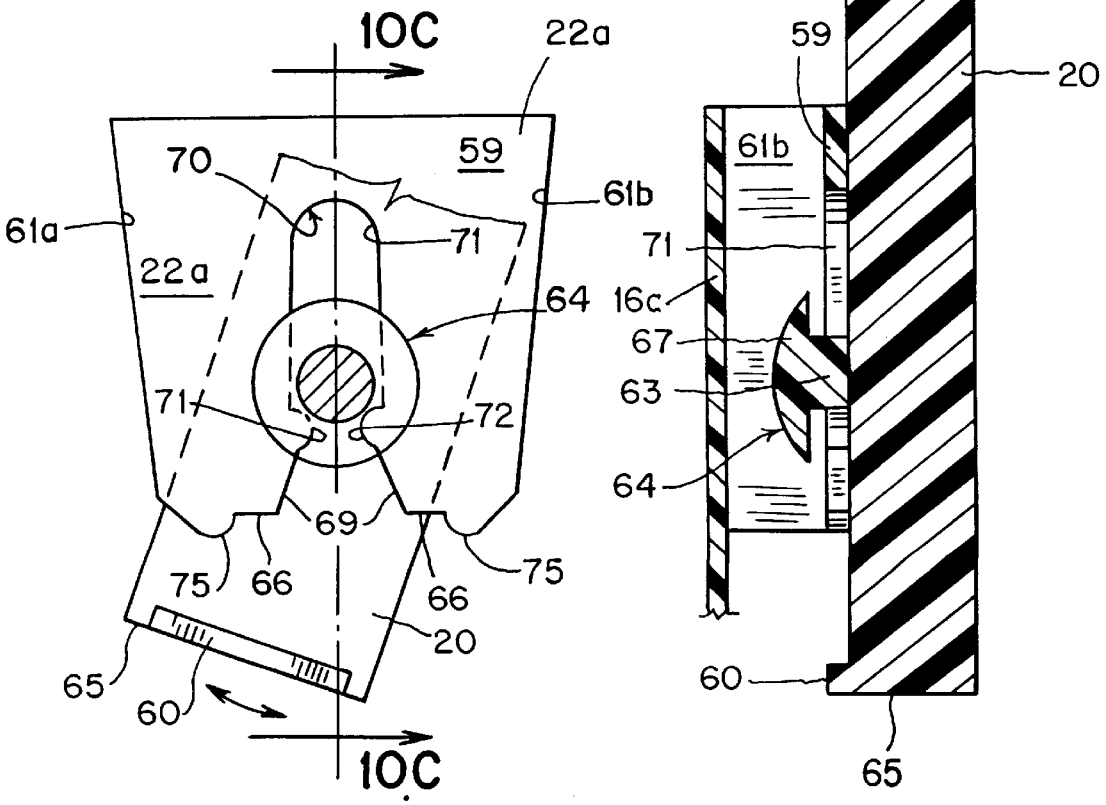

MOP BUCKET HAVING A MOP STABILIZING STRUCTURE

RELATED APPLICATION

This application is a continuation-in-part of U.S. Pat. application Ser. No. 08/746,504 filed on Nov. 12, 1996, now U.S. Pat. No. 5,813,567.

BACKGROUND OF THE INVENTION

1 Field of the Invention

The invention relates to mop buckets. More particularly, the invention relates to a mop bucket which incorporates structure for stabilizing a mop in a substantially upright position.

2 State of the Art

Mops and mop buckets are well known in the art and the principal disadvantage of mop buckets is also well known. Mops generally have a relatively long handle relative to the height of a mop bucket. When a mop is placed in a mop bucket, the handle of the mop rests against the inner lip of the bucket at an angle relative to the vertical. Depending on the size of the bucket and the weight of the mop handle, the inclination of the mop handle is likely sufficient to cause the mop to fall out of the bucket and/or cause the bucket to tip over and spill its contents. For this reason, during mopping operations, one must be careful when leaving a mop in a mop bucket. Despite the fact that this aspect of mop buckets is well known and the fact that good care is almost universally taken when leaving mops in buckets, in practice, mops fall out of buckets quite often during use. In fact, in many cases, it is simple impossible for a mop bucket to support a mop in a stable position regardless of the amount of care taken when leaving the mop in the bucket.

U.S. Pat. No. 3,756,451 to Popeil discloses a mop bucket having very specific dimensions and a U-shaped handle which incorporates a rotatable hook for supporting a mop handle. While the Popeil bucket may be effective in preventing spills, it requires careful construction, is limited to buckets having specific shapes and dimensions, requires moving parts, and is somewhat inconvenient to use. In order to support the mop in the bucket, the user must be sure that the U-shaped handle is raised to a vertical position and the rotatable hook is rotated into the proper position, a procedure which requires two hands. Removal of the mop from the bucket involves substantially the same careful attention.

U.S. Pat. No. 4,121,798 to Schumacher et al. discloses a "utensil handle holder" for holding the elongated handle of any of a variety of utensils in a generally vertical position. The holder includes a clip portion for grasping a handle and a pair of spaced apart flanges for attaching the holder to a container wall. While this utensil holder might be effective in stabilizing a mop in a bucket to prevent spills, it has several disadvantages. First, it must be carefully secured to the mop bucket, and in order to accomplish that, it must be properly dimensioned for a particular bucket. Second, the clip portion is designed to grasp the utensil handle with "resilient jaws". This requires that the user push the mop handle into the clip portion against the bias of the jaws. Unless the jaws are carefully matched to the mop handle, this operation could actually cause the bucket to tip over, cause the holder to disengage from the bucket, or simply fail to grasp the mop handle. Even in the best situation, it is probably advisable that two hands be used to stabilize the bucket while engaging and disengaging the mop handle from the holder.

U.S. Pat. No. 4,722,113 to Olsson discloses a mop handle stabilizer consisting of two parts: a first part which is attached to a mop handle and a second part which is attached to the wall of a mop bucket. The first part has a projection and the second part has a slot to receive the projection. The Olsson device has many apparent disadvantages. First, it requires careful permanent attachment to both the mop and the bucket. Second, the first part must be properly dimensioned for a particular mop handle. Third, in order to insert the first part into the second part, they must be carefully aligned. Fourth, additional devices are required for each mop used with a particular bucket. Fifth, the mounted location of the first part on the mop handle must correspond to the mounted location of the second part on the bucket. Thus, the mop may not be usable with a second bucket having another second part attached to it if the dimensions of the second bucket differ significantly from the dimensions of the first bucket.

Parent U.S. patent application Ser. No. 08/706,504 solves many of the problems noted in the prior art and provides for a mop bucket which comprises an integral mop stabilizing structure for supporting the mop handle of a mop in an upright position to prevent the mop from falling out of the bucket or from tipping the bucket over.

More particularly, the parent application provides for a conventional molded polyethylene bucket having an upper lip, lower base, side walls, mop bucket handle and a supporting shelf located adjacent to the side walls. The supporting shelf is provided with a tapered notch which is preferably tapered in the direction toward the side wall and which engages the mop handle to maintain the same in a substantially upright position during handling.

According to another embodiment of the parent application, the lower base is provided with an anti-skid structure to prevent the working end of the mop from sliding along the base of the bucket under slippery or "soapy" conditions. More particularly, the anti-skid structure of the parent application comprises a plurality of raised protrusions or nipples which are generally arranged in a spaced apart fashion and which are dimensioned in the form of a quadrant of a sphere, i.e., one flat side facing the shelf and an opposite arcuate spherical wedge-like side.

While the structures taught in the above parent application provide many important advantages, the present application affords several important improvements.

SUMMARY OF THE INVENTION

Accordingly, it is an object of the present invention to provide an improved mop stabilizing structure for use in a mop bucket.

It is also an object of the invention to provide a mop stabilizing structure which accommodates a variety of mop types and sizes.

It is still another object of the invention to provide a mop stabilizer which is inexpensive to manufacture, simple to use and is adaptable to a variety of buckets having different sizes and shapes.

It is another object of the invention to provide a mop stabilizing structure which secures th e mop in a substantially upright position.

It is a more particular object of the invention to provide a novel handle locking device for preventing unwanted lateral swaying or swinging of the mop bucket relative to the handle during lifting and transport of the bucket from one location to another.

Certain of the foregoing and related objects are readily attained according to the present invention by the provision of a mop bucket having a base and a least one sidewall and a mop handle support member which extends inwardly from one of the side walls and is located above the base of the bucket. The mop handle support member includes a notched shelf which is vertically positioned inside a mop bucket above the base and preferably below the lip. Most advantageously, the shelf has a tapered notch for accommodating a variety of mop types and sizes. Preferably, the inner periphery of the notch comprises a web-like material for snugly, yet resiliently, securing the mop within the notch in a wedge-like manner.

Advantageously, the mop bucket also comprises means for locking the handle in an upright vertical position relative to the bucket. The locking means advantagiously comprises a pair of oppositely disposed bosses which are attached to the sidewall of the mop bucket. Each of these bosses has a downwardly opening slot located within the same for engaging a button-shaped locking member and the mop bucket handle has a pair of button-shaped locking members attached at opposite ends of the same which are each receivably engageable with one of the slots of the bosses so that the button members are generally positionable between an unlocked position and a locked position. When in locked position, the mop bucket handle is maintained in a stationary and rigid position relative to the mop bucket and the mop bucket handle does not pivot during lifting, handling or transport.

In addition, and according to another embodiment of the invention, the lower interior or base of the bucket is preferably provided with an anti-skidding surface which is also preferably integrally formed with the bucket. Advantageously, at least one row of the anti-skid surface is vertically aligned with the free end of the supporting shelf or the notch that the working end of the mop head will abut against the anti-skid surface when the mop is disposed in an upright maner in the bucket.

Additional objects and advantages of the invention will become apparent to those skilled in the art upon reference to the detailed description taken in conjunction with the drawings.

BRIEF DESCRIPTION OF THE DRAWINGS

FIG. 10A is an side elevational view of the bucket showing the mop bucket handle in a freely pivotable unlocked position;

FIG. 10B is a fragmentarily-illustrated, enlarged elevational end view of the mop handle at the point of engagement with the mop bucket boss handle, the handle being shown in its normal, free-pivotal position;

FIG. 10C is a fragmentarily-illustrated enlarged longitudinal cross section of the boss and locking device of FIG. 10B.

DETAILED DESCRIPTION OF THE PREFERRED EMBODIMENTS

Figure 1:
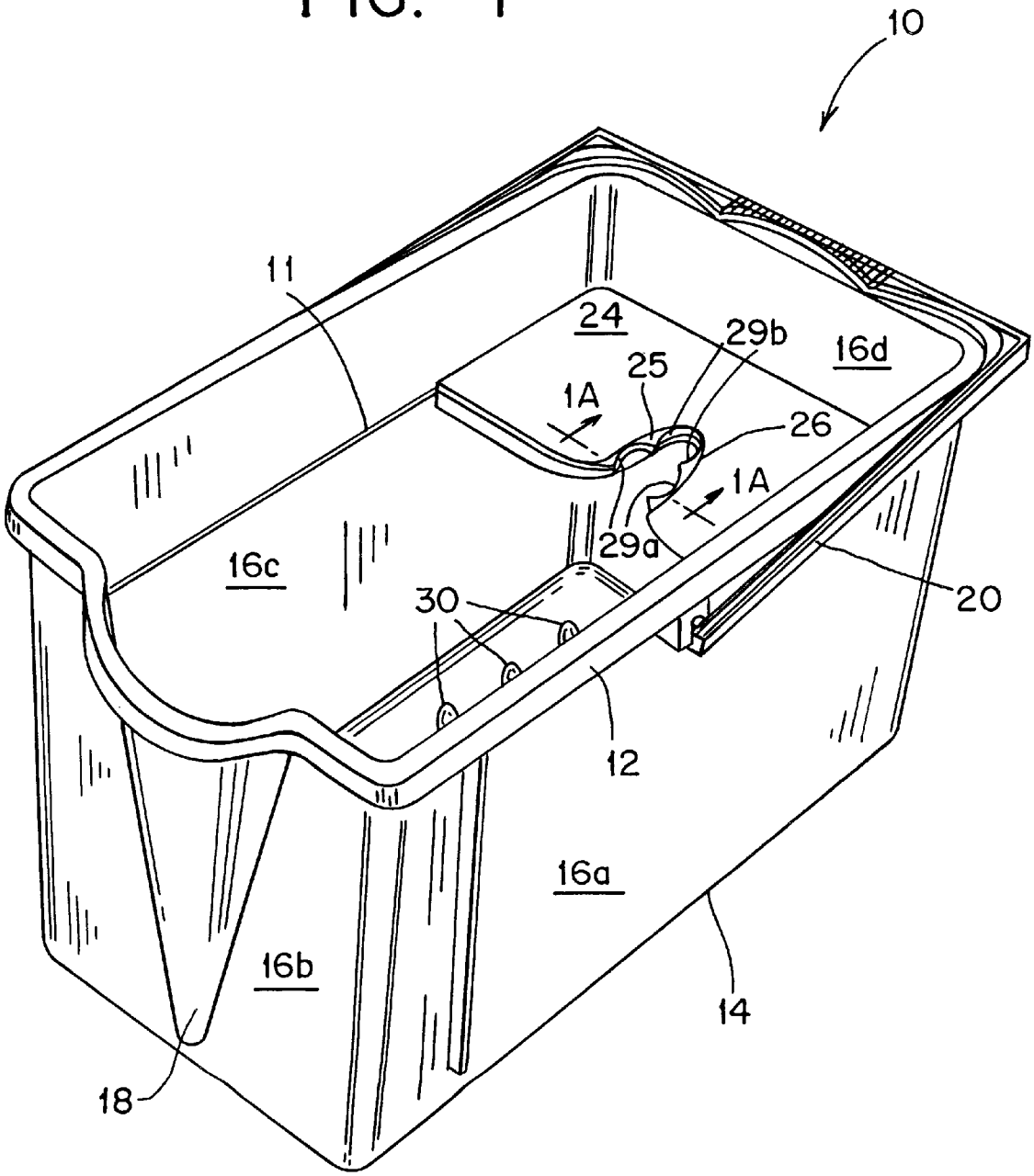
FIG. 1 is a perspective view of a first embodiment of a mop bucket incorporating mop stabilizing structure according to the invention.

Referring now to FIGS. 1 through 4, a rectangular-shaped mop bucket 10 according to a first embodiment of the invention resembles a conventional molded polyethylene bucket having an upper lip 12, a lower base 14, and side walls 16*a* –16*d*. The often bucket 10 includes a spout 18 formed in a side wall, e.g., side wall 16*b* and a generally inverted U-shaped handle 20, the free ends of which are engageable with bosses 22*a*, 22*b* which are molded below the lip 12, as described in greater detail hereinafter.

Figure 1A:
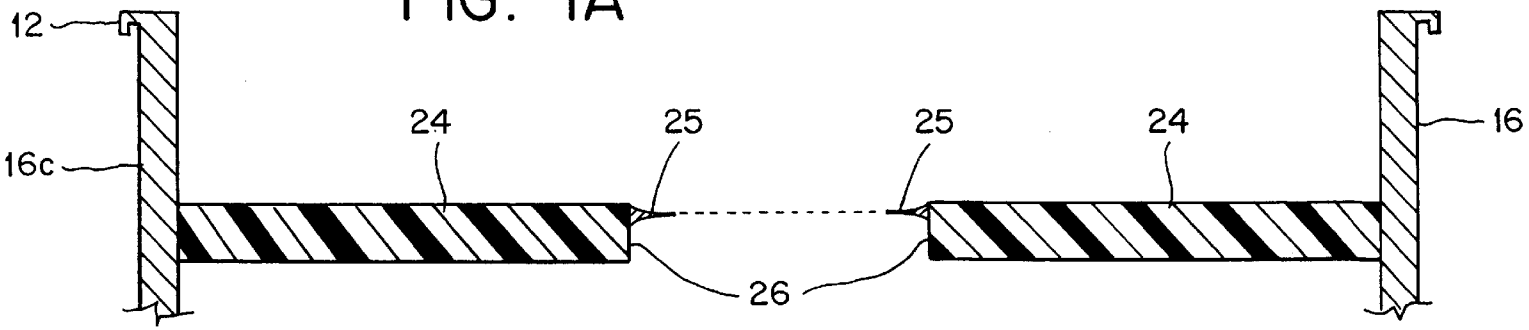
FIG. 1A is an enlarged, fragmentarily-illustrated sectional view of the notched shelf taken along line 1A—1A of FIG. 1.

According to the invention, a mop supporting structure 24 is arranged adjacent to side walls 16*a*, 16*c*, and 16*d* below the lip 12 and above the base 14. As shown in FIGS. 1 through 4, the mop supporting structure 24 is embodied as a shelf which extends from side wall 16*d* toward the center of the bucket 10. The shelf 24 is provided with a central notch 26 which is preferably tapered in the direction toward the side wall 16*d*. As shown in FIG. 1A, preferably, a thinned, web-like material 25 forms a narrow lip along the inner periphery of notch 26 which acts to firmly grasp and secure the mop handle 42, 52 (See FIGS. 5 and 6) in place when the mop 40, 50 is positioned in the bucket 10. As can be appreciated, the resilient characteristics of the web-like lip 25 will snugly engage and secure the mop handle 42 in a wedge-like manner when placed into the notch 26 and prevent slippage of the mop handle 42 when positioned in the bucket 10. Advantageously, web-like lip 25 has resilient memory retaining characteristics which will enable the material 25 to regain its original form when the mop 40, 50 is repeatably removed from and inserted into notch 26 of bucket 10.

Preferably, web-like lip 25 has two pairs of opposing arcuate-like cut-outs 29*a*, 29*b* formed therein for receiving and accommodating different mop handle widths to thereby facilitate the upright position of the same in the mop bucket when not in use. As can be appreciated in FIGS. 5 and 6, the provision of a tapered notch 26 and a web-like lip 25 allow many different sizes of mops to be snugly positioned within the notch 26 and held in an upright position.

Figure 4:
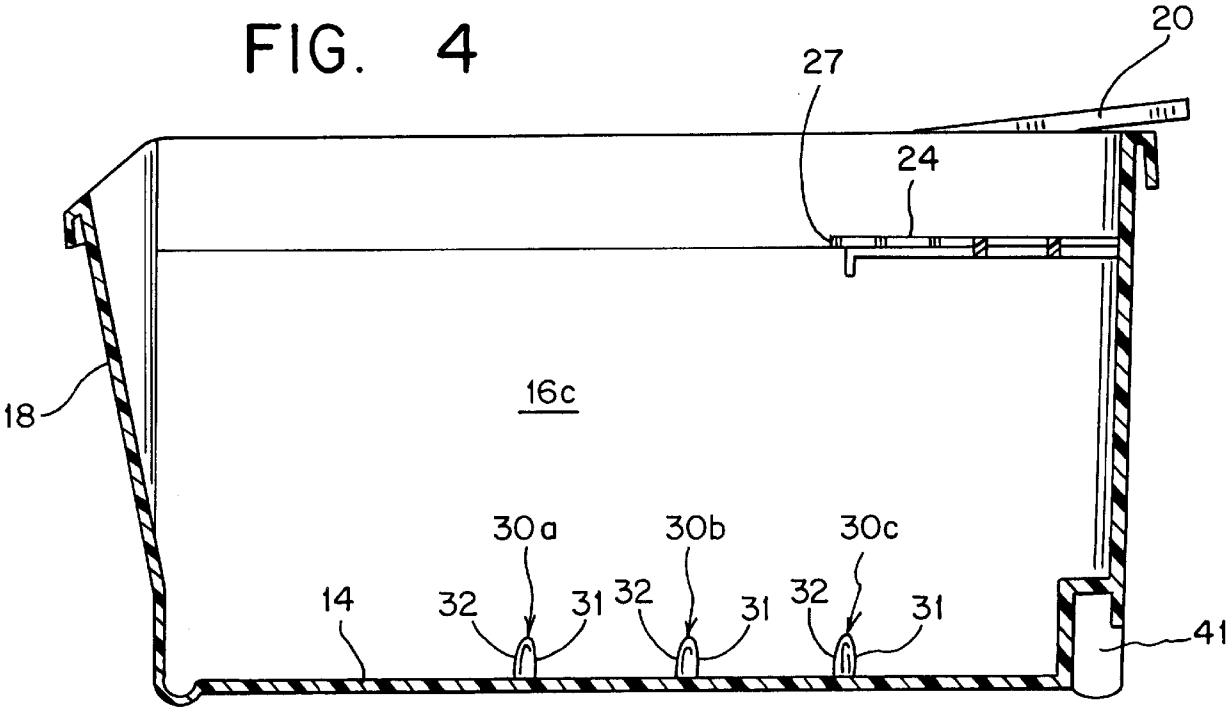
FIG. 4 is a sectional view taken along line 4—4 in FIG. 2.
Figure 2:
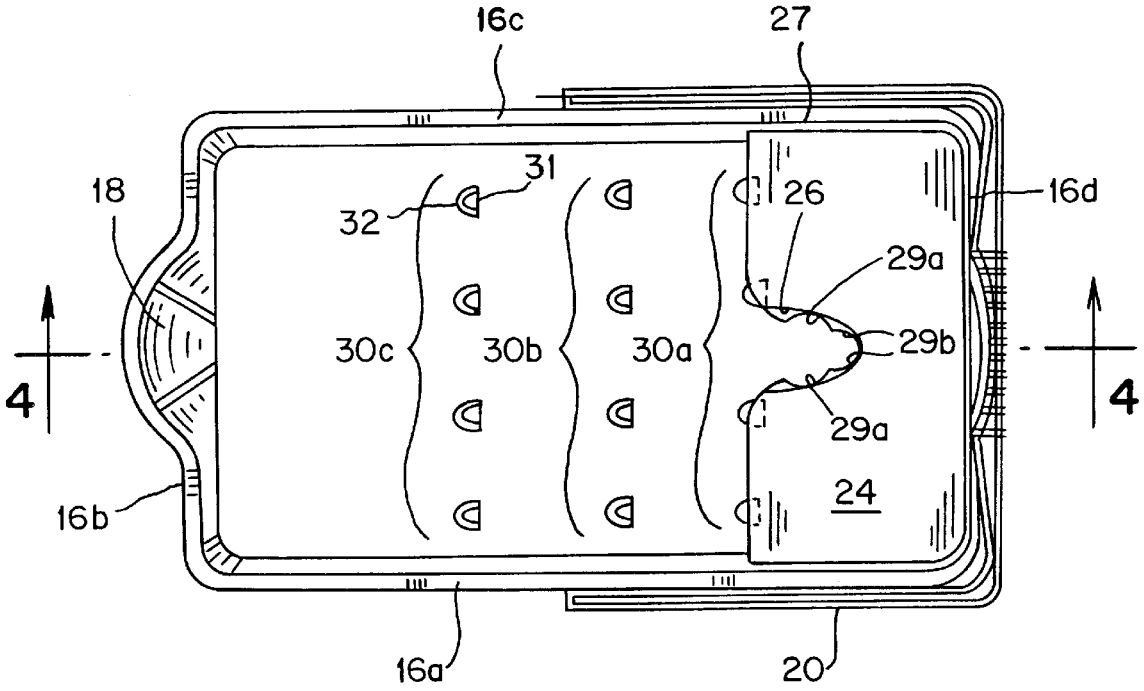
FIG. 2 is a plan view of the bucket of FIG. 1.
Figure 3:
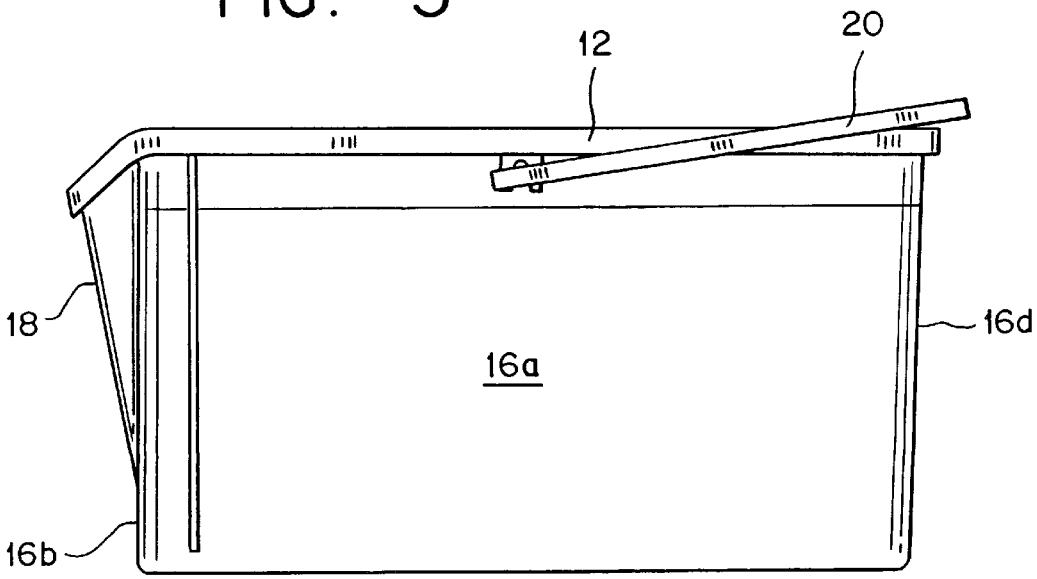
FIG. 3 is a side elevation view of the bucket of FIG. 1.

In addition, and as seen best in FIGS. 2 and 4, an anti-skid structure 30 is preferably provided on the inner surface of the bucket base 14. According to this first embodiment, the anti-skid structure 30 includes a plurality of spaced-apart rows of upwardly extending bosses or nipples, preferably generally in the form of a quadrant of a sphere with one flat side 31 facing shelf 24 and an opposite arcuate spherical wedge-like side 32. As seen best in FIG. 2, the extending bosses or nipples 30 are positioned in such a manner that the first row 30*a* is in substantial vertical alignment or registry with notch 26 or end 27 of shelf 24. As can be appreciated, by aligning the nipple row 30*a* with notch 26 or end 27 in this fashion, when the mop heads 44, 54 of mops 40, 50 (See FIGS. 5 and 6) are placed into the bucket 10 and biased against row 30*a*, the handles 42, 52, when secured by lip 25 in notch 26, will rest in a vertical orientation.

Figure 5:
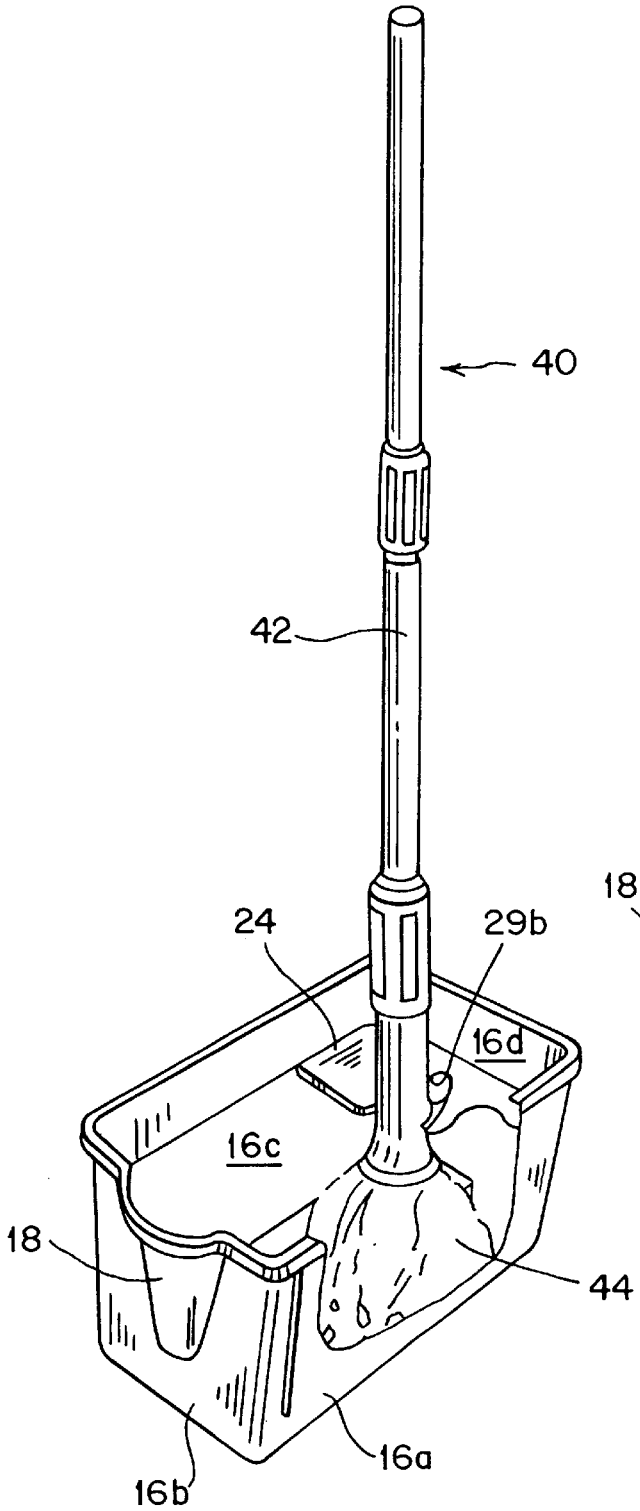
FIG. 5 is a cut-away perspective view of the bucket of FIG. 1 with a string mop stabilized in an upright position.
Figure 6:
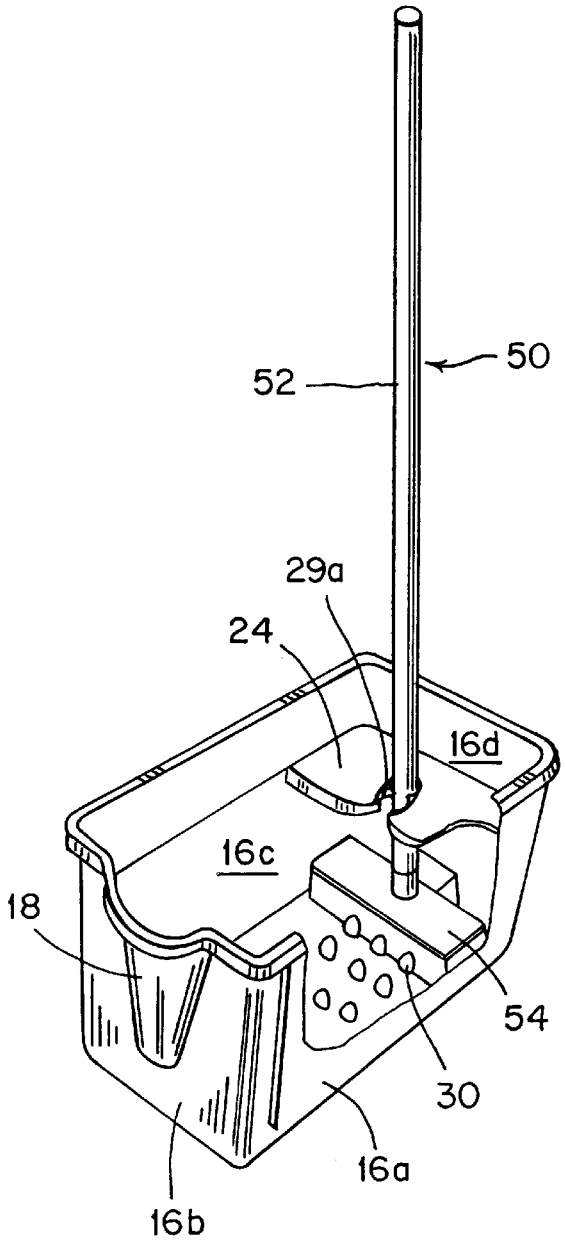
FIG. 6 is a cut away perspective view of the bucket of FIG. 1 with a sponge mop stabilized in a substantially vertical position.

From the foregoing and with reference to FIGS. 5 and 6, those skilled in the art will appreciate that the mop supporting structure 24 described above will effectively engage and maintain a mop handle in a substantially upright position to prevent the mop from falling out of the bucket 10 or from tipping the bucket over. Moreover, the anti-skid structure 30 will further engage the mop head 44, 54 of a mop 40, 50 to prevent it from sliding across the base of the bucket, even under slippery soapy conditions. For example, as shown in FIG. 5, a string head mop 40 having a relatively large diameter handle 42 will be effectively engaged by the larger arcuate cut-out 29*a* of the web-like lip 25 in notch 26. Moreover, the string mop head 44 of the mop 40 will be engaged by the raised nipples 30 on the inner surface of the base 14 of the bucket 10. Also, as shown in FIG. 6, the relatively smaller diameter handle 52 of a sponge mop 50 will be effectively engaged by the narrower arcuate cut-out 29*b* of the lip 25. Moreover, the sponge mop head 54 of the mop 50 will be engaged by the raised nipples 30 on the inner surface of the base 14 of the bucket 10.

The anti-skid structure 30 is preferably formed as an integral part of a one-piece mop bucket 10. However, a suitably dimensioned insertable structure could be fabricated for a "standard size" mop bucket. The shelf 24 could also be integrally molded with the mop bucket 10 or provided as a separate piece which is either permanently or removably mounted in the bucket 10. As shown in FIG. 1, the bucket sidewalls 16*a*–16*d* are preferably provided with a ledge 11 on which the shelf 24 may rest.

From the foregoing, those skilled in the art will appreciate that the main features of the invention include a mop handle supporting structure which extends inward from a side wall of a mop bucket and an anti-skid structure on the inner surface of the bucket base. As shown above, the supporting shelf structure 24 has an added feature of providing a resting place for scrub brushes, wash rags, soap, and the like. However, as will be shown below, a shelf structure is not necessary to support the mop handle. Furthermore, the embodiment described above includes a rectilinear mop bucket, the invention can be applied to buckets of different shapes.

Figure 7:
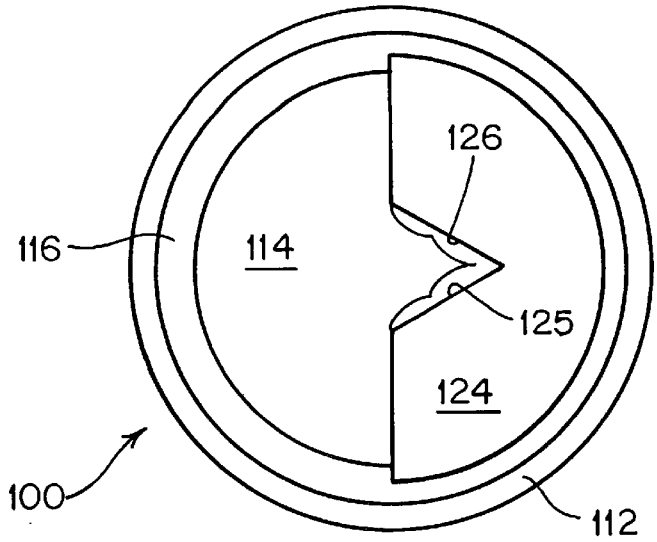
FIG. 7 is a plan view of the second embodiment of a mop bucket incorporating a mop stabilizing structure according to the invention.

Turning now to FIG. 7, a frustoconical bucket 100 according to the invention has a circular upper lip 112, a circular base 114, and a single side wall 116. According to the invention, an arcuate shelf 124 with a tapered notch 126 is provided between the upper lip 112 and the base 114. As mentioned above, in one preferred embodiment, a web-like lip 125 is provided along the inner periphery of tapered notch 126. It will be appreciated that the shelf 124 need not circumscribe a semi-circle or a continuous arc and may be formed as a notched chord.

Figure 8:
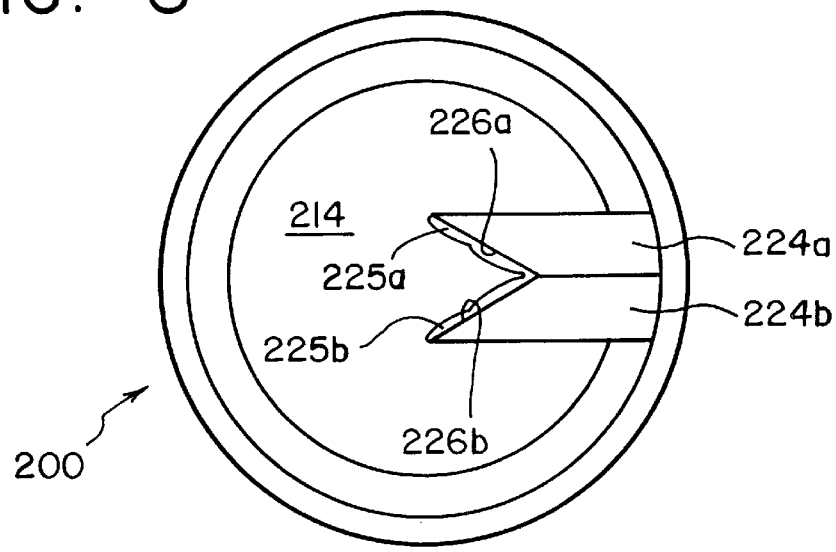
FIG. 8 is a plan view of the third embodiment of a mop bucket incorporating a mop stabilizing arms instead of shelf according to the invention.

Referring now to FIG. 8, still another embodiment of a bucket 200 according to the invention has an upper lip 212, a lower base 214, a side wall 216, and a pair of supporting arms 224*a*, 224*b* which extend inwardly between the lip and the base. The arms each have a tapered end 226*a*, 226*b* which define a receiving well 226 for supporting the mop handle 42, 52 and the receiving well 226 further comprises a lip comprised of a thinned section of formed web-like material 225*a*, 225*b* attached thereto for resiliently grasping the mop handle 42, 52 (not shown). It will also be appreciated that in lieu of a pair of arms, a single arm with a notched end could be utilized.

Figure 9:
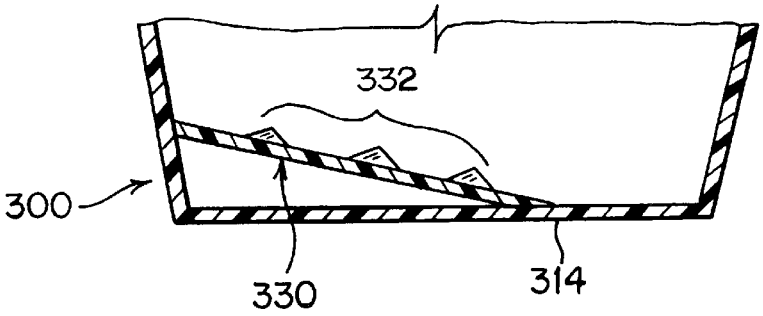
FIG. 9 is a broken, longitudinal cross-section electional view of a fourth embodiment of the mop bucket incorporating a mop stabilizing structure according to the invention.

As mentioned above, the mop supporting structure of the invention preferably includes an anti-skid structure. As described above, the anti-skid structure has been shown as a plurality of raised protrusions 30 on the inner surface of the base of the bucket. However, the anti-skid structure may be formed in a number of different ways. For example, FIG. 9 shows a fourth embodiment of a mop bucket 300 wherein the anti-skid structure is a ramp 330 which has its lowest part under the mop arm support structure. optionally, the ramp 330 may be provided with an additional anti-skid surface 332.

Figure 11A:
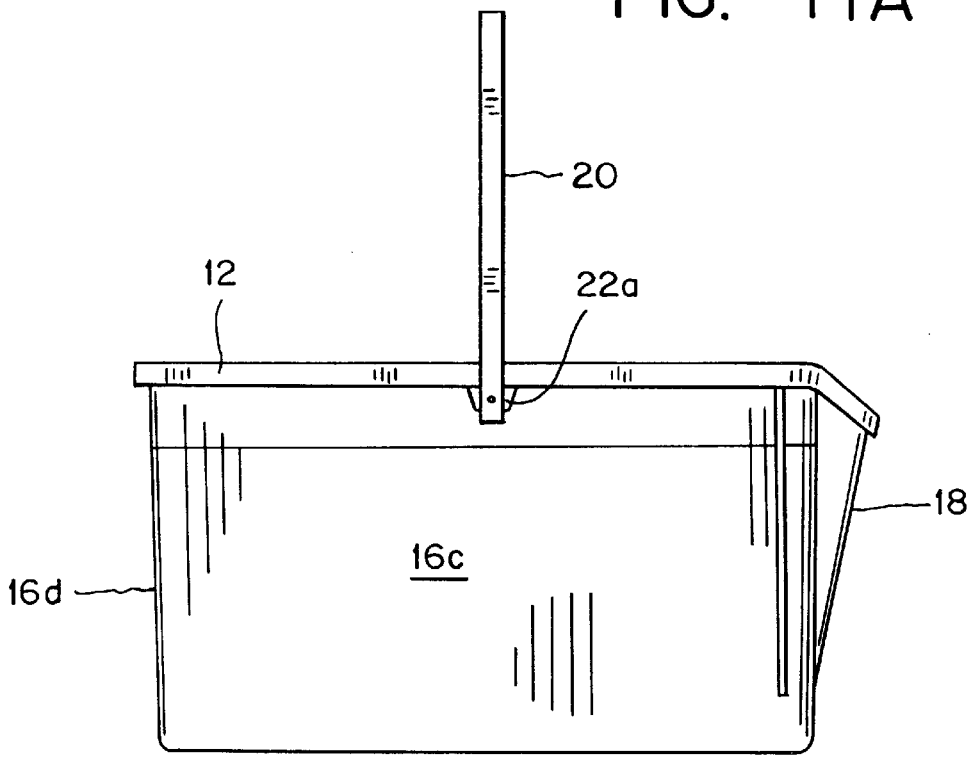
FIG. 11A is an side elevational view of the bucket showing the mop bucket handle in a locked travel position.

Turning now to FIGS. 10A, 10B and 10C and 11A, 11B and 11C which show various views of how the mop bucket handle locking device operates; FIG. 10A shows the mop bucket handle 20 in its normal freely pivotable position and FIG. 11*a* shows the mop bucket handle 20 in a locked position during carrying or transport.

In particular, FIGS. 10A, 10B and 10C depict one embodiment of the mop bucket bosses 22*a* and 22*b* (not shown) which are molded under the lip 12 of mop bucket 10 and which pivotally and non-pivotally support the ends of the mop bucket handle 20. Since bosses 22*a* and 22*b* are vertical and engage handle 20 in an identical fashion, only the construction and interaction of boss 22*a* with the handle will be explained hereinafter.

Boss 22*a* is box-like and has an interior open space defined in part by a pair of sidewalls 61*a*, 61*b* and a front wall 59. Front wall 59 has a downwardly opening, generally inverted U-shaped, channel or slot 70 formed thereon. Channel 70 has an upper elongated slot region 71, the lower end of which is joined by a narrow neck region 72 to an enlarged and downwardly and outwardly flared lower region 69 which in turn is joined by a shoulder 66 to a further enlarged open mouth region 75.

The inner sides of ends of the u-shaped handle 20 each have an inwardly directed flange 60 at its tip 65 and a mushroom-shaped button 64 disposed adjacent to each end but spaced from the inner flange 60. The button 64 has an enlarged generally semi-spherical head 67 joined by a narrow neck 63 to the inner side of the ends of the handle 20.

As shown in FIG. 10A–10C, the button 64 is inserted in channel 70 such that its neck 63 slides within the channel to and its enlarged head 67 slides behind it within the interior open space of the boss 22*a*. The button 64 is normally captured for free sliding and pivotable movement with the upper elongated slot region 71 via the narrow neck portion 72 of the slot 70 which has a width less than the neck portion 63 of the button 64. Due to the weight of the handle 20 the button 64 will rest just above the narrow neck region 72 of the slot 70 for free pivotable mounting in the direction of the arrows.

Figure 11B:
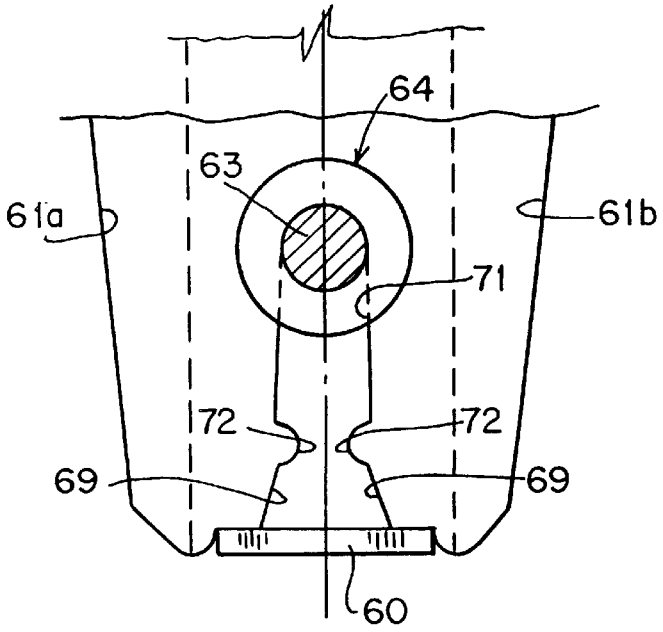
FIG. 11B is a fragmentarily-illustrated, enlarged elevational end view of the mop bucket handle at the point of engagement with the mop bucket boss, the handle being shown in the locked position.
Figure 11C:
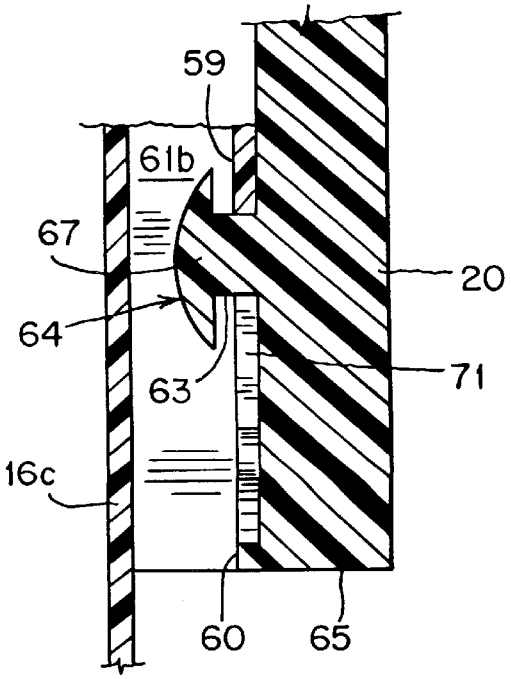
FIG. 11C is a fragmentarily-illustrated, enlarged longitudinal cross section of the boss and locking device of FIG. 11B.

As shown in FIGS. 11*a* –11*c*, the handle 20 can be moved into a rigid locked vertical position relative to the bucket 10 to prevent the pivotal movement thereof. In particular, the handle 20 is positioned in an upright manner and then raised sharply such that the button 64 slides to the upper end 71 of the slot region 70. At the same time flange 60 of the handle 20 will be releasably engaged and wedged within the open mouth 75 of the channel 70, thereby locking the handle 20 in place preventing pivotable movement thereof.

As can be appreciated, when the button lock 64 and the flange 60 are positioned in this manner, i.e., in locked position, the flange 60 restricts the overall lateral swaying of the mop bucket 10 relative to the handle 20 thus maintaining mop bucket handle 20 stationary and rigid relative to the mop bucket 10 which provides stability during lifting, handling and transport.

For example, with a conventional mop and pivotable handle arrangement, to move the bucket 10 with the mop 40, 50 in the bucket the bucket is subject to unintentional tipping and dumping of the water from the bucket 10 due to the imbalance caused by the mop 40, 50. As can be appreciated, with the present invention, when the handle 20 is locked in place, the bucket 10 cannot pivot relative to the handle 20 as a result of which the mop 40, 50 cannot cause tipping of the bucket 10.

Handle 20 is returned to its normal free-pivoting position (as depicted in FIG. 10) by disengaging flange 60 from the mouth 75 of channel 70. Once disengaged, button 64 is free to slide in channel 70 to the resting or unlocked position wherein flange 60 rests below the mouth 75 of channel 70.

Figure 12:
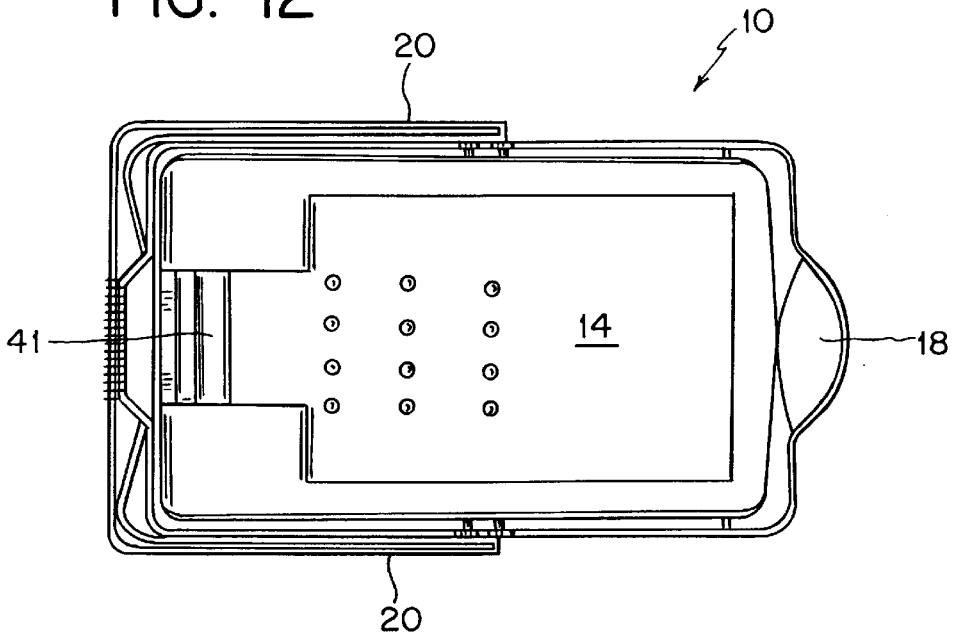
FIG. 12 is a bottom view of the mop bucket showing a recessed handle.

FIG. 12 shows a bottom view of the mop bucket 10 having a recessed handle 41 located at one end thereof. Preferably, handle 41 is recessed,within the outer side of base 14 such that at least one portion of the handle protrudes into bucket 10. Advantageously, the handle 41 is located near sidewall 16*d* and opposite spout 18 to facilitate pouring contents from the bucket 10. As can be appreciated, by forming the handle 41 on the bottom of base 14 in this manner, the mop bucket user can grasp handle 41 when pouring the contents from the bucket 10 through spout 18.

Figure 13:
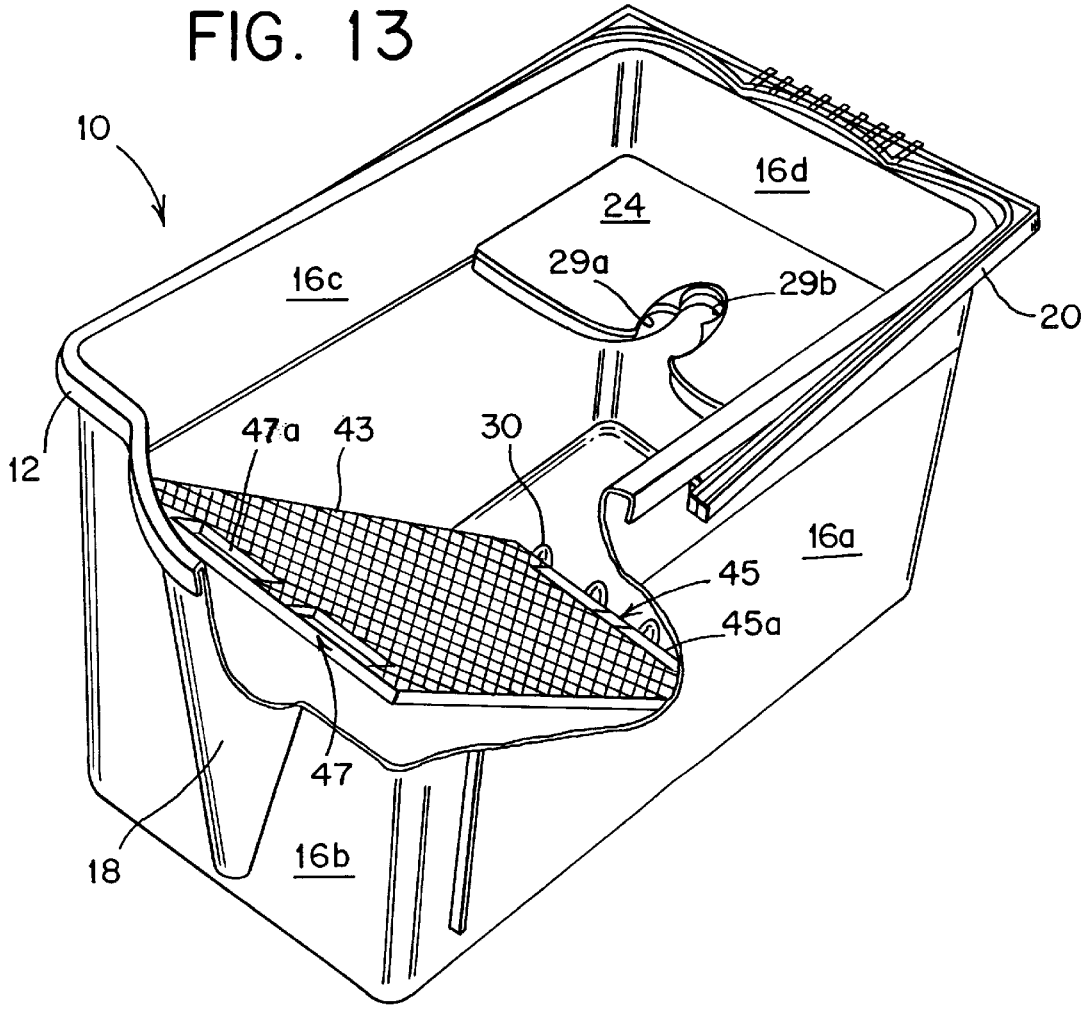
FIG. 13 is a broken top perspective view of the mop bucket shown with a removable paint tray.

FIG. 13 shows another embodiment of the mop bucket having a removable paint tray or paint grid 43. Preferably, paint tray 43 is selectively positionable at various positions within the mop bucket 10 in an inclined manner. In the particular embodiment shown in FIG. 13, paint grid 43 comprises a first end 45 and a second end 47, each of said ends 45, 47 having a groove or slot 45*a*, 47*a*, respectively, located therein. During use, first end 45 is positioned within bucket 10 so that groove 45*a* engages or abuts at least one nipple 30 to keep grid 43 from sliding while positioned with bucket 10. Second end 47 is then leaned against sidewall 16*b* below lip 12 thus providing an inclined surface for removing excess paint from the paint roller (not shown). Preferably, both ends 45, 47 of the paint grid are identical such that either end 45 or 47 can be positioned to engage nipples 30.

There have been described and illustrated herein several embodiments of a mop supporting structure for use in a mop bucket and buckets incorporating such structure. While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope as so claimed.

What is claimed is:

1. A mop bucket comprising:

a base and at least one sidewall; and a mop handle support member extending inwardly from said at least one side wall and located above said base of said bucket, said support member comprising a notched end for engaging a mop handle, said notched end having a relatively thin web-like inner peripheral lip.

2. A mop according to claim 1, further comprising:

an anti-skid structure located on an inner surface of said base of said bucket for engaging a mop head.

3. A mop according to claim 1, wherein said support member is a shelf.

4. A mop according to claim 1, wherein said notched end is tapered.

5. A mop according to claim 4, wherein said support member is an arm.

6. A mop according to claim 2, wherein said anti-skid structure comprises a textured surface.

7. A mop according to claim 6, wherein said textured surface comprises a plurality of raised protrusions.

8. A mop according to claim 6, wherein said support comprises a shelf having a free end and said textured surface comprises a plurality of raised protrusions which are arranged in at least one row and wherein at least one of said rows is substantially aligned with said free end of said shelf.

9. A mop according to claim 2, wherein said anti-skid structure is a ramped surface.

10. A mop according to claim 9, wherein said anti-skid structure includes a plurality of raised protrusions on said ramped surface.

11. A mop according to claim 1, wherein said support member is located below a lip of the bucket.

12. A mop bucket according to claim 1, wherein said inner peripheral lip has at least one pair of opposing arcuate-like cut-outs dimensioned to receive and grasp a mop handle.

13. A mop bucket according to claim 1, further comprising a handle well formed within said base dimensioned to receive a person's hand.

14. A mop bucket according to claim 1, further comprising a paint grid which is selectively positionable within said mop bucket.

15. A mop bucket comprising:

a base and at least one sidewall;

a mop handle support member extending inwardly from said at least one sidewall and located above said base of said bucket, said support member having a free end which is notched for engaging a mop handle; and said base having a textured surface located thereon which comprises a plurality of raised protrusions which are arranged in a plurality of rows and wherein at least one of said rows is substantially vertically aligned with said free end of said support member.

* * * * *